United States Patent [19]

Fujikawa et al.

[11] 4,109,622

[45] Aug. 29, 1978

[54] TWO STROKE ENGINES

[75] Inventors: Tetsuzo Fujikawa, Kobe; Noriaki Fujii, Akashi, both of Japan

[73] Assignee: Kawasaki Jukogyo Kabushiki Kaisha, Kobe, Japan

[21] Appl. No.: 750,453

[22] Filed: Dec. 14, 1976

[30] Foreign Application Priority Data

Dec. 16, 1975 [JP] Japan ..... 50-150373

[51] Int. Cl.[2] ..... F02B 33/04

[52] U.S. Cl. ..... 123/73 A; 123/73 PP; 74/597

[58] Field of Search ..... 123/73 R, 73 A, 73 PP, 123/DIG. 7; 74/595, 597, 598

[56] References Cited

U.S. PATENT DOCUMENTS

| | | | |
|---|---|---|---|
| 1,264,247 | 4/1918 | Wygodsky | 123/73 A |
| 1,423,365 | 7/1922 | Smith | 74/597 |
| 1,531,066 | 3/1925 | Brice | 123/73 A |
| 2,218,332 | 10/1940 | Fowler | 123/73 A |
| 2,586,467 | 2/1952 | Jacobson | 123/73 A |
| 3,374,776 | 3/1968 | Hooper | 123/73 R |
| 3,612,014 | 10/1971 | Teaney | 123/73 R |
| 3,971,297 | 7/1976 | Fox | 123/73 PP |

FOREIGN PATENT DOCUMENTS

| | | | |
|---|---|---|---|
| 934,813 | 6/1948 | France | 123/DIG. 3 |
| 90,406 | 10/1958 | Netherlands | 123/73 A |

*Primary Examiner*—Charles J. Myhre
*Assistant Examiner*—David D. Reynolds
*Attorney, Agent, or Firm*—Fleit & Jacobson

[57] ABSTRACT

Two stroke engines of crankcase precompression type comprising an integral main body block which includes a cylinder block section and a crankcase upper section, and to which a crankcase lower section and a cylinder head are secured at the lower and upper ends thereof. The body block is formed with scavenging passages of which lower ends are substantially straight so as to facilitate removal of the block from manufacturing dies. The engine includes a crankshaft which is supported by bearings secured to the crankcase lower section by means of separate semi-circular retaining members.

3 Claims, 5 Drawing Figures

TWO STROKE ENGINES

The present invention relates to two stroke internal combustion engines and more particularly to crankcase precombustion type engines.

Conventionally, crankcase precombustion type two stroke engines comprise a crankcase which is divided into an upper and lower halves, a cylinder block secured to the upper half of the crankcase and a cylinder head secured to the cylinder block. The cylinder block defines a cylinder bore in which a piston is slidably received. The piston is connected through a connecting rod with a crankshaft which is rotatably disposed in the crankcase. The crankcase halves are formed with paired semicircular portions at their mating surfaces so as to form circular or cylindrical openings for accomodating crankshaft support bearings.

The crankcase defines a crankchamber in which the aforementioned crankshaft is rotatably disposed. The crankchamber is connected through scavenging passages formed in the cylinder block with scavenging ports opening to the cylinder bore. The upper half of the crankcase is usually formed with a curved recess for providing smooth and curved contours of the scavenging passages at or in the vicinity of the opening to the crankchamber.

Due to this particular configuration of the scavenging passages in the cylinder block and in the upper half of the crankcase, it has been believed in the art that the cylinder block and the crankcase upper half cannot be designed as a one-piece construction when they are to be manufactured through a die-casting technique. Since the scavenging passages are curved radially inwardly both at the upper and lower ends and the crankcase usually has portions located radially inwardly of the scavenging passages for supporting the crankshaft bearings, it is impossible to remove products from manufacturing dies when the cylinder block and the crankcase upper half are designed integrally or in one-piece construction. Thus, in conventional two stroke engines of this type, the cylinder block and the crankcase upper half have been separated as previously described.

In the conventional engines, it has therefore been required to assemble the cylinder head, the cylinder block and the crankcase upper half using connecting bolts which are long enough to extend from the cylinder head through the overall length of the cylinder block to the crankcase upper half. For the purpose of ensuring effective seal at the mating surfaces between the cylinder head and the cylinder block and between the cylinder block and the crankcase upper half, the connecting bolts must be located as close as possible to the wall surface of the cylinder bore. Thus, there is a strong possibility that the connecting bolts interfere with the scavenging passages and, in order to avoid such interference, there are restrictions in determining the locations and cross-sectional configurations of the scavenging passages. Further, such separated cylinder block and crankcase upper half are expensive in manufacture through die-casting technique.

It is therefore an object of the present invention to provide crankcase precompression type two stroke engines including integral cylinder block and crankcase upper half.

Another object of the present invention is to provide two stroke engines having novel means for securing crankshaft support bearings.

Further object of the present invention is to provide two stroke engines having a cylinder block and a crankcase upper half which are of one-piece design but can be readily manufactured through a die-casting technique.

According to the present invention, the above and other objects can be accomplished by a two stroke engine comprising an integral main body block which includes a cylinder block section having a cylinder bore defined therein and a crankcase upper section, a crankcase lower section connected to the crankcase upper section of the body block to define a crankchamber together with the crankcase upper section, a cylinder head connected with the cylinder block section of the body block, a piston slidably received in the cylinder bore, a crankshaft rotatably disposed in said crankchamber and connected with said piston through a connecting rod, scavenging ports formed in the cylinder block section to open to the cylinder bore, scavenging passages formed in said body block and having upper ends connected with the scavenging ports and substantially straight lower ends communicating with the crankchamber, said crankcase lower section having semi-circular recessed means for receiving bearing means for the crankshaft, and retaining means secured to the crankcase lower section for retaining said bearing means on the recessed means of the crankcase lower section.

According to a preferable mode of the present invention, the scavenging passages open to the crankchamber in the vicinity of said retaining means, and the retaining means has upper surfaces which are curved radially inwardly of the crankchamber so as to provide the scavenging passages with smooth and radially inwardly curved configuration at the lower portions thereof.

The above and other objects and features of the present invention will become apparent from the following descriptions taking reference to the accompanying drawings, in which.

Figure 1:
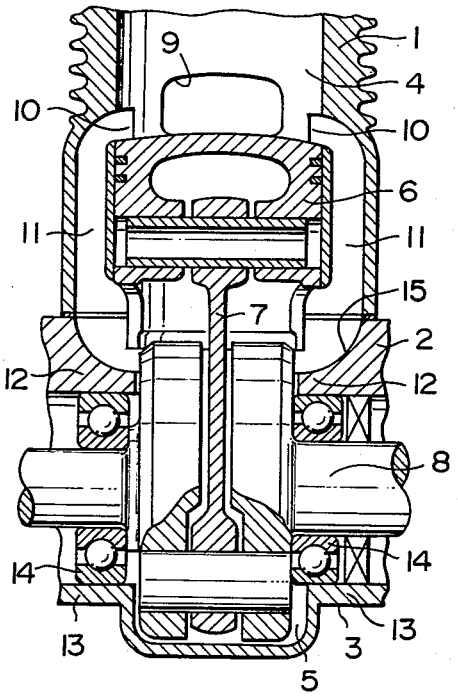
FIG. 1 PRIOR ART
FIG. 1 is a sectional view of a conventional two stroke engine.

Referring now to the drawings, particularly to FIG. 1, the two stroke engine shown therein includes a cylinder block 1, a crankcase upper section 2 and a crankcase lower section 3, which are separatedly manufactured and connected together in a later assembling operation.

The cylinder block 1 defines a cylinder bore 4 and the crankcase upper and lower sections 2 and 3 together define a crankchamber 5. In the cylinder bore 4, there is slidably received a piston 6 which is connected through a connecting rod 7 with a crankshaft 8 disposed rotatably in the crankchamber 5. The cylinder block 1 is formed with an exhaust port 9 and a pair of diametrically opposed scavenging ports 10 which are adapted to be cylically closed by the piston 6 when it reciprocates in the cylinder bore 4. The scavenging ports 10 are connected through corresponding scavenging passages 11 with the crankchamber 5 which is supplied with air or air-fuel mixture through an intake port, not shown in FIG. 1.

The crankcase upper and lower sections 2 and 3 are formed with co-operating bearing housing parts 12 and 13, respectively, which together form circular or cylindrical recesses for receiving crankshaft support bearings 14. The crankcase upper section 2 has upper surfaces 15 at the area of the bearing housing parts 12, the upper surfaces 15 being curved radially inwardly to provide radially inwardly curved configurations of the scavenging passages 11.

The aforementioned type of two stroke engine has been assembled by using connecting bolts which are long enough to extend from the cylinder head (not shown in FIG. 1) through the cylinder block 1 into the crankcase upper section 2. The crankcase lower section 3 has been connected to the crankcase upper section 2 by means of a further set of connecting bolts. Since the first mentioned set of connecting bolts extend through the cylinder block 1 and they must be located as closely as possible in order to ensure gas-tightness at the interfaces between the cylinder head and the cylinder block and between the cylinder block and the crankcase upper section. Such arrangements of connecting bolts produce problems of interference between the bolts and the scavenging passages, so that there have been restrictions in determining the locations and cross-sectional configurations of the scavenging passages.

Figure 2:
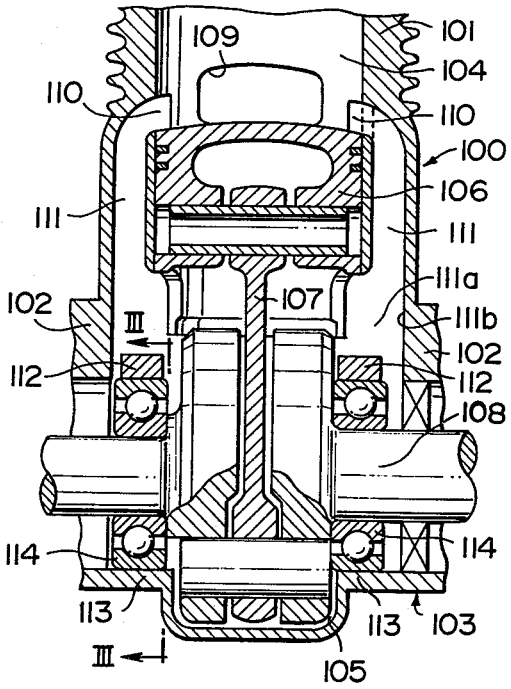
FIG. 2 is a sectional view similar to FIG. 1 but showing one embodiment of the present invention.
Figure 3:
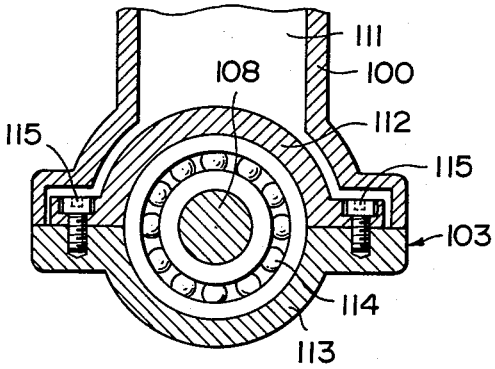
FIG. 3 is a sectional view taken substantially along the line III—III in FIG. 2.
Figure 4:
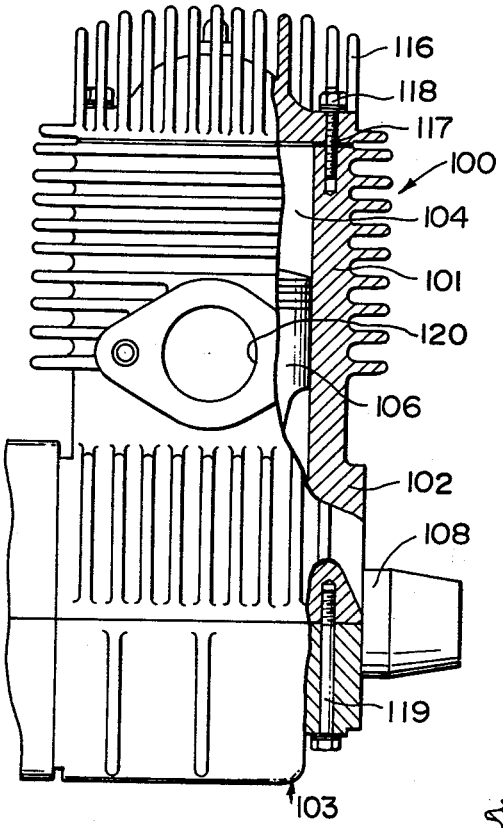
FIG. 4 is a partially broken away front view of the engine shown in FIGS. 2 and 3.

Referring now to FIGS. 2 through 4 which show one embodiment of the present invention with corresponding parts designated by the same reference numerals as in FIG. 1 with addition of FIG. 100, the cylinder block section 101 is formed integrally with the crankcase upper section 102 in the form of a main body block 100. In order to make it possible to form the block 100 by means of die-casting, each of the scavenging passages 111 has a lower portion 111*a*, which is defined by a substantially straight outer wall 111*b*. Thus, the crankcase upper section 102 no longer has a bearing housing part as in the conventional engine.

In order to securely hold the crankshaft support bearings 114, the crankcase lower section 103 is formed with semi-circular bearing housing parts 113 as in the conventional engine and semi-circular bearing retaining members 112 are secured by means of bolts 115 to the bearing housing parts 113.

Referring to FIG. 4 which shows the appearance of the engine under discussion, it will be seen that since the main body block 100 is of one-piece construction to include the cylinder block portion 101 and the crankcase upper section 102, the cylinder head 116 can be secured to the cylinder block section 101 of the body block 100 with relatively short studs 117 and co-operating nuts 118. Further, the crankcase lower section 103 is also secured to the body block 100 by means of relatively short bolts 119.

In FIG. 4, it will further be noted that the illustrated engine is formed in the main body block with an intake port 120 which is adapted to introduce air or air-fuel mixture to the crankchamber 105.

The bearing retaining arrangement in the illustrated embodiment of the present invention is advantageous over the conventional arrangement in that the retaining member can be bolted to the crankcase lower section at portions very close to the bearing so that there is least possibility that the bearing outer race is displaced or crept under load in use. Further, the integral construction of the main body block provides various advantages over prior art. For example, connecting bolts of large length are no longer required for assembling the cylinder head, the cylinder block and the crankcase upper section and there will be no problem of interference between the connecting bolts and the scavenging passages. Further, it is no longer necessary to perform expensive machining operation for providing the mating surfaces between the cylinder block and the crankcase upper section.

Figure 5:
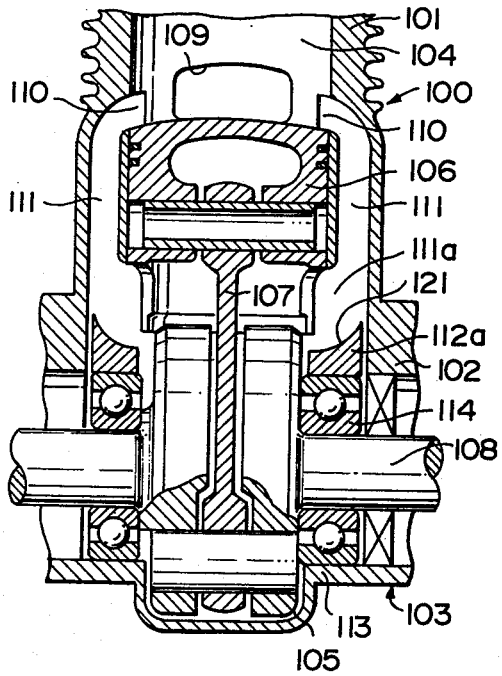
FIG. 5 is a sectional view of a two stroke engine similar to FIGS. 1 and 2 but showing another embodiment of the present invention.

Referring now to FIG. 5, there is shown another embodiment of the present invention which is identical to the previous embodiment except the configuration of the bearing retaining member. In this embodiment, each bearing retaining member 112*a* has an upper surface 121 which is exposed to the lower end of the scavenging passage 111 and curved radially inwardly to provide a smooth radially inward curvature of the scavenging passage lower end.

The invention has thus been shown and described with reference to specific embodiments, however, it should be noted that such embodiments have been shown only by way of example and that the invention is in no way limited to the details of the illustrated arrangements but changes and modifications may be made without departing from the scope of the appended claims.

We claim:

1. Crankcase precompression type two stroke internal combustion engine comprising an integral main body block which includes a cylinder block section having a cylinder bore defined therein and a crankcase upper section, a crankcase lower section connected to the crankcase upper section of the body block to define a crankchamber together with the crankcase upper section, a cylinder head connected with the cylinder block section of the body block, a piston slidably received in the cylinder bore, a crankshaft rotatably disposed in said crankchamber and connected with said piston through a connecting rod, scavenging ports formed in the cylinder block section to open to the cylinder bore, scavenging passages formed in said body block so as to extend substantially parallel with the cylinder bore and having upper ends respectively connected with the scavenging ports, said scavenging passages having substantially straight lower ends communicating with the crankchamber, said crankcase lower section having semi-circular recessed means in said crankchamber for receiving bearing means for the crankshaft, and retaining means provided in said crankchamber and secured to the crankcase lower section for cooperation with the recessed means so that said bearing means is retained in the crankchamber on the recessed means of the crankcase lower section.

2. Two stroke engine in accordance with claim 1 in which the scavenging passages open to the crankchamber in the vicinity of said retaining means, and the retaining means has upper surfaces which are curved radially inwardly of the crankchamber so as to provide the scavenging passages with smooth and radially inwardly curved configuration at the lower portions thereof.

3. Two stroke engine in accordance with claim 1 in which said cylinder head is secured to the main body block by fastening stud means of short length.

* * * * *